US005819649A

United States Patent [19]

Townsend et al.

[11] Patent Number: 5,819,649

[45] Date of Patent: Oct. 13, 1998

[54] SYSTEM AND METHOD FOR PRINTING ON A MOVING SUBSTRATE

[75] Inventors: Lawrence B. Townsend, Downers Grove; Sampan Toktaeng, Streamwood; Allen P. Blacker, Jr., Hoffman Estates, all of Ill.

[73] Assignee: Illinois Tool Works Inc., Glenview, Ill.

[21] Appl. No.: 798,085

[22] Filed: Feb. 12, 1997

[51] Int. Cl.[6] ..... B41J 2/30

[52] U.S. Cl. ..... 101/93.01; 400/157.3; 400/279

[58] Field of Search ..... 400/68, 902, 103, 400/104, 124.04, 279, 320, 322, 157.2, 157.3, 166; 101/93.01, 93.05

[56] References Cited

U.S. PATENT DOCUMENTS

| | | | |
|---|---|---|---|
| 4,026,401 | 5/1977 | Doane | 400/124.04 |
| 4,844,635 | 7/1989 | Malkemes et al. | 400/124.04 |
| 5,191,356 | 3/1993 | Shibamiya | 400/124.04 |
| 5,310,272 | 5/1994 | Nishizawa | 400/124.04 |
| 5,312,193 | 5/1994 | Kringe et al. | 400/124.04 |

*Primary Examiner*—Ren Yan
*Assistant Examiner*—Steven S. Kelley
*Attorney, Agent, or Firm*—John P. O'Brien

[57] ABSTRACT

A system for printing an image onto a target area of a moving substrate with an actuatable print head having an actuation delay time, the substrate movable at a variable speed to a print position relative to the print head. The system includes a trigger signal generator for generating a trigger signal when the target area of the substrate is a specified distance from the print position so selected that a time required to move the target area of the substrate the specified distance to the print position is not less than the actuation delay time of the print head. Encoder signals based on movement of the substrate decrement a reference count during a delay time to generate a delay count, wherein the delay time corresponds to the actuation delay time of the print head. The encoder signals decrement the delay count in response to the generation of a trigger signal, wherein a print signal is generated when the delay count is decremented to zero. The print head is actuated in response to the print signal to print the image accurately positioned onto the target area of the substrate. The system may be implemented with a digital computing device or discreet components.

9 Claims, 2 Drawing Sheets

SYSTEM AND METHOD FOR PRINTING ON A MOVING SUBSTRATE

BACKGROUND OF THE INVENTION

The invention relates generally to methods and systems for printing an image onto a moving substrate with an actuatable print head having an actuation delay time, and more particularly to printing methods and systems that compensate for the actuation delay of the print head and compensate for variable substrate speed to accurately position the printed image onto a target area of the moving substrate.

Printing systems having actuatable print heads are often integrated with packaging machine operations for printing images like lot numbers, expiration dates, product codes, price, and other variable information onto target areas of packaging or wrappers moved relative to the print head. The packaging or wrappers are referred to herein generally as a substrate. Until recently, the substrate was moved intermittently by the packaging machine to align, or position, each target area of the substrate in a print position relative to the print head, which was then actuated to print or imprint an image onto the target area of the stationary substrate. After each printing operation, the substrate was again moved intermittently to position the next target area in the print position, and the printing operation repeated. According to this printing scheme, it is necessary only to accurately position the target area of the substrate in the print position relative to the print head to ensure that the image is printed accurately onto the target area of the substrate since the substrate is not moving during the printing operation.

In newer packaging machine operations, the substrate moves continuously, and there is a tendency to increase substrate speeds to improve productivity. The substrate speed may vary, for example, from less than 100 inches per minute to more than 1800 inches per minute. The continuously moving substrate, however, complicates the printing operation, and often results in inaccurate positioning of the printed image onto the target area of the substrate, which is characterized by a shifting of the printed image relative to the target area.

One factor affecting the positioning of the printed image onto the target area of the substrate is a time delay inherent in the actuation of mechanically operated print heads, which is referred to herein as the print head actuation delay time. More specifically, there is generally a time lag between generation of a print signal and impact of the print head on the substrate. In pneumatic print heads, for example, the actuation delay time includes time require for a solenoid to switch pressurized air between air ports, time for air pressure to accumulate in an air cylinder, and time for the print head to move into contact with the substrate. The print head actuation delay times of pneumatic printers varies however depending on many factors including air supply pressure, air line size, and the mass and distance moved by the print head. Generally, print head actuation delay times range between the order of 1 millisecond and 1000 milliseconds, and may be more or less depending on the particular type of printer. Another factor affecting the positioning of the printed image onto the target area of the substrate is variation in substrate speed, which depends on many variables including the availability of the articles to be packaged and the packaging rate.

FIG. 2 is a graphical representation of substrate movement versus print head actuation delay time for several substrate speeds ranging from 103 inches per minute to 1850 inches per minute. The graph shows, for example, that a 17 millisecond print head actuation delay time at a substrate speed of 103 inches per minute corresponds approximately to 1/32 of an inch distance moved by the substrate. The printed image is thus shifted 1/32 of an inch distance relative to the target area of the substrate. The same 17 millisecond actuation delay time at an increased substrate speed of 1850 inches per minute corresponds to an image shift of almost 17/32 of an inch distance. Thus, a relatively slow substrate speed results in a relatively small image shift, which may be tolerated in some applications. But slow substrate speeds adversely affect productivity. And in other applications, the image must be positioned on the target area of the substrate to tolerances less than 1/32 of an inch. In pharmaceutical industry packaging operations, for example, accurate positioning of the image onto the target area is necessary for subsequent scanning of the printed image by optical imaging equipment. At higher substrate speeds, productivity is improved, but the image shift is significantly greater, and for many applications results in unacceptable positioning of the image on the substrate.

In view of the discussion above, among other considerations, there exists a demonstrated need for an advancement in the art of printing images on moving substrates.

It is therefore an object of the invention to provide novel systems and methods for printing images on moving substrates that overcome problems in the prior art.

It is also an object of the invention to provide novel systems and methods for printing images onto target areas of moving substrates that compensate for print head actuation delay time.

It is another object of the invention to provide novel systems and methods for printing images onto target areas of moving substrates that compensate for variations in substrate speed.

It is another object of the invention to provide novel systems and methods for printing images onto target areas of moving substrates by generating a trigger signal when a target area of the substrate is a distance from a print position, the distance so selected that a time required for the target area to move to the print position is not less than an actuation delay time of the print head.

It is another object of the invention to provide novel systems and methods for printing images onto target areas of moving substrates by generating first signals based on movement of the substrate, wherein the first signals are generated with an encoder for every incremental unit of distance moved by the substrate.

It is a further object of the invention to provide novel systems and methods for printing images onto moving substrates by storing a reference count corresponding to a number of first signals generated as a target area of the substrate moves a distance to a print position, the distance so selected that a time required for the target area to move to the print position is not less than an actuation delay time of the print head, generating a delay count by decrementing the reference count for every first signal generated during the delay time, decrementing the delay count for every first signal generated upon generation of a trigger signal, and generating a print signal when the delay count is decremented to zero, wherein generation of the print signal is delayed for the delay count in response to the trigger signal to accurately print the image on the target area of the substrate.

These and other objects, features and advantages of the present invention will become more fully apparent upon consideration of the following Detailed Description of the Invention with the accompanying Drawings, which may be disproportionate for ease of understanding, wherein like structure and steps are referenced by corresponding numerals and indicators.

DETAILED DESCRIPTION OF THE INVENTION

Figure 1:
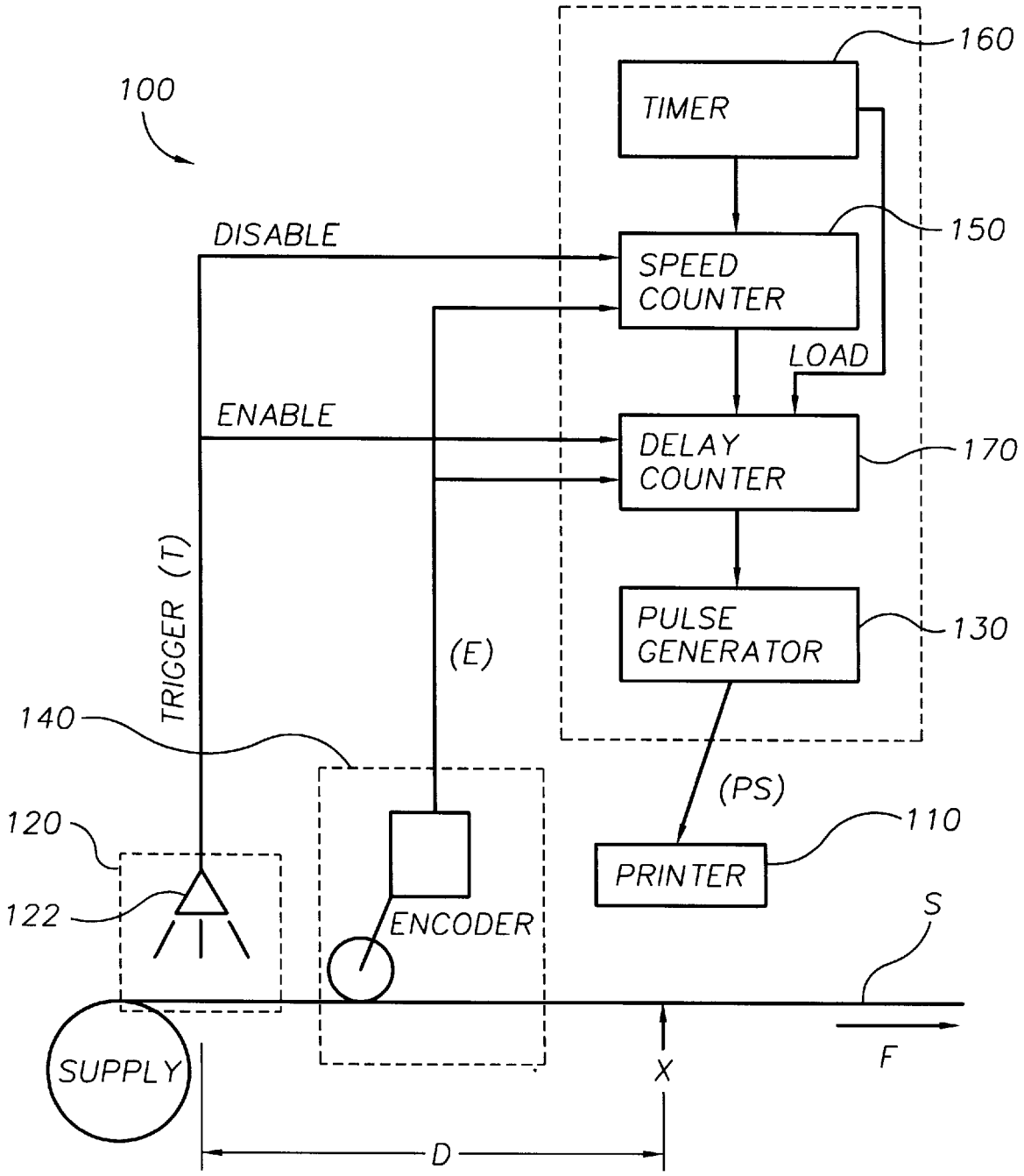
FIG. 1 is a diagrammatic view of a system for printing an image onto a moving substrate, for compensating for a print head actuation delay time, and for compensating for variable substrate speed, according to an exemplary embodiment of the invention.

FIG. 1 is a diagrammatic view of a system 100 for printing an image onto target areas of a substrate S moving at a variable speed in a direction indicated by arrow F. The substrate S may be a continuous series of packages or wrappers supplied in a packaging machine operation that applies the packages to articles after an image is printed onto a target area of each package. A printer 110 including an actuatable print head having an actuation delay time is positioned proximate to the moving substrate S relative to a print position X where the print head impacts the substrate to print the image thereon. The print head is actuated to apply the image onto the target area of substrate S in response to a print signal PS when the target area of the substrate is at the print position X. The printing operation is performed intermittently so that an image is printed on a series of target areas spaced apart on the moving substrate in response to a corresponding series of temporally spaced print signals PS, which are generated as further discussed below. The present invention has utility for any printer or imprinter having an actuation delay time. These printers include, but are not limited to, the 812B™ imprinter, the PS1™ imprinter, and the Roadrunner 1™ imprinter, which are all available from Norwood Marking Systems, an Illinois Tool Works Company, Downers Grove, Ill. The print head actuation delay time is a characteristic of each printer and is generally ascertainable by measurement.

The system 100 includes a trigger signal generator 120 located proximate to the substrate S upstream of the print position X for generating a trigger signal T when the target area of the substrate is at a distance D from the print position X, wherein the trigger signal T is generated before the target area of the substrate moves to the print position. The trigger signal generator 120 may, for example, be an optical eye 122 that generates the trigger signal T upon detection of the target area, or upon detection of some other index, on the substrate S at the distance D as the substrate moves toward the print position X. The system 100 also includes a pulse generator 130 for generating a print signal PS in response to the trigger signal T. The print signal PS actuates the print head, and its generation is timed so that the print head impacts the substrate when the target area of the substrate has moved to the print position, wherein the image is printed onto the target area of the substrate.

The distance D from the location of the trigger signal generator 120 to the print position X must be selected to compensate for the print head actuation delay time. More specifically, the time required for the target area of the substrate to move the distance D from the location of the trigger signal generator 120 to the print position X generally must not be less than the actuation delay time of the print head. Otherwise, the target area of the substrate will have moved beyond the print position when the print head impacts the substrate and the printed image will be inaccurately positioned relative to the target area of the substrate. If the time required for the target area of the substrate to move the distance D from the location of the trigger signal generator 120 to the print position X is greater than the actuation delay time of the print head, the generation of the print signal PS, in response to the trigger signal T, must be appropriately delayed. Generally, the time required for the target area of the substrate to move the distance D from the location of the trigger signal generator 120 to the print position X must be timed to correspond with the impact of the print head on the substrate after generation of the print signal PS to ensure accurate positioning of the printed image relative to the target area of the substrate.

The distance D between the location of the trigger signal generator 120 and the print position X may be determined by multiplying a reference substrate speed $v_{ref}$ by the print head actuation delay time. The substrate reference speed $v_{ref}$ is preferably a maximum substrate speed anticipated for a particular application. In a special case where the substrate moves at a constant speed without variation, the distance D may be determined during a test print while moving the substrate at the speed of interest. According to this configuration, the trigger signal T may be used as the print signal PS to actuate the print head without any delay. In most applications, however, the substrate speed is variable and generation of the print signal PS must be delayed in response to the trigger signal to compensate for variations in substrate speed.

According to another aspect of the invention, an encoder 140 generates pulses E, or signals, based on movement of the substrate to obtain a measure of substrate movement, wherein the encoder 140 generates a signal for every incremental unit of distance moved by the substrate. In one embodiment, the encoder 140 is a rotary encoder in contact with the moving substrate. The signals generated by the encoder decrement a REFERENCE COUNT over a DELAY TIME period corresponding to the actuation delay time of the print head to generate a DELAY COUNT. The DELAY COUNT is then stored. The REFERENCE COUNT corresponds to the number of first signals generated by the encoder as the target area of the substrate moves the distance D to the print position X. According to this aspect of the invention, the DELAY TIME together with the time required for the encoder to generate a number of signals corresponding to the DELAY COUNT corresponds to the time required for the substrate to move the distance D. After generation of a trigger signal T, the generation of the print signal PS must thus be delayed for the time required for the encoder to generate a number of signals corresponding to the DELAY COUNT to ensure accurate positioning of the printed image relative to the target area of the substrate.

According to a related aspect of the invention, the DELAY COUNT is generated repeatedly in a sequence controlled by a timer having a period corresponding to the DELAY TIME, wherein a DELAY COUNT is generated for every period of the timer by decrementing the REFERENCE COUNT with encoder signals as discussed above. When the timer times out, the DELAY COUNT is stored, and the REFERENCE COUNT is reset to generate the next DELAY COUNT. The most recently generated DELAY COUNT replaces the previously stored DELAY COUNT. Upon generation of a trigger signal T, which occurs upon detection of a target area of the substrate the distance D from the print position X, the encoder signals decrement the stored DELAY COUNT. When the DELAY COUNT is decremented to zero, a print signal PS is generated wherein the target area of the substrate is moved to the print position as the print head impacts the substrate to print the image accurately positioned onto the target area. The process is then repeated to print the next image on the next target area of the substrate.

In the exemplary embodiment of FIG. 1, the encoder signals decrement a REFERENCE COUNT in a speed counter device 150, or first counter, over the period of an asynchronous timer device 160 to generate the DELAY COUNT, wherein the period of the timer 160 corresponds to the actuation delay time of the print head, or DELAY TIME. When the timer 160 times out, the DELAY COUNT is stored in a delay counter device 170, or second counter, and the speed counter 150 is reset to generate the next DELAY COUNT. The DELAY COUNT is thus continuously generated by the speed counter 150, and the new DELAY COUNT is loaded into the delay counter 170 under control of the asynchronous timer 160. When a trigger signal T is generated the speed counter 150 is disabled and the delay counter 170 is enabled. The encoder signals then decrement the DELAY COUNT stored in the enabled delay counter 170. And when the DELAY COUNT is decremented to zero, the delay counter 170 signals the pulse generator 130 to generate a print signal PS, wherein the target area of the substrate is moved to the print position as the print head impacts the substrate to print the image accurately positioned onto the target area. The process is then repeated to print the next image on the next target area of the substrate.

In an alternative embodiment, the REFERENCE COUNT is stored in a first memory register of a digital computing device, the DELAY COUNT is stored in a second memory register of the digital computing device, and the DELAY TIME period corresponding to the print head actuation delay time is stored in a third memory register of the digital computing device. According to this alternative embodiment, the REFERENCE COUNT stored in the first memory register is decremented by the encoder signals over the DELAY TIME to generate the DELAY COUNT, which is stored in the second memory register. And the DELAY COUNT stored in the second memory register is decremented by the encoder signals in response to the generation of a trigger signal T, wherein the digital computing device generates a print signal PS when the DELAY COUNT is decremented to zero to actuate the print head.

These concepts are illustrated below with numerical examples. Assume that the encoder 140 generates a signal for every 1/32 of an inch moved by the substrate, the print head actuation delay time is 30 milliseconds, and the distance D is 30/32 of an inch. The DELAY TIME period of the timer 160 is thus set to 30 milliseconds, and the REFERENCE COUNT of the speed counter is set to 30 since 30 encoder counts correspond to the substrate S moving the distance D.

Figure 2:
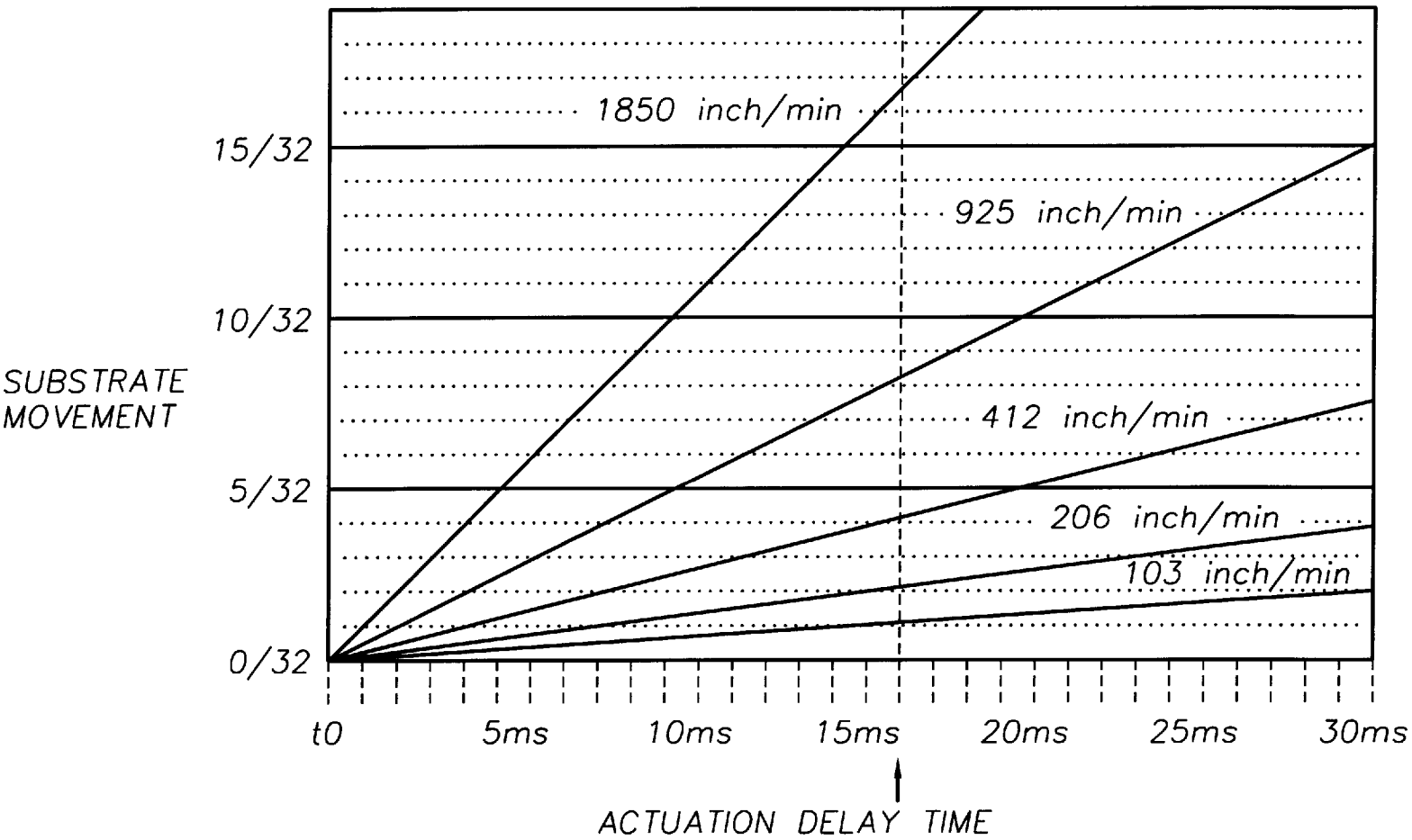
FIG. 2 is a graphical representation of substrate movement versus print head actuation delay time for several substrate speeds ranging from 103 inches per minute to 1850 inches per minute.

In a first example, the substrate moves at a speed of 100 inches per minute. By reference to FIG. 2, the substrate S moves not quite 2/32 of an inch in 30 milliseconds, which is the period of the timer 160. But this movement corresponds to only one signal generated by the encoder 140 since the substrate must move a full 1/32 inch before the encoder generates a signal. The speed counter thus decrements the reference count of 30 by 1 resulting in a DELAY COUNT of 29, which is stored in the delay counter 170. A trigger signal T disables the speed counter 160 and enables the delay counter 170. The encoder signals then decrement the DELAY COUNT of the enabled delay counter 170 until the DELAY COUNT reaches zero at which time the print signal is generated. According to this example, when the DELAY COUNT of 29 reaches zero, the target area of the substrate S will have moved 29/30 of an inch, which is almost to the print position, before the print signal PS is generated. But the print head actuation delay time is 30 milliseconds, which corresponds to an additional distance that is just less than 2/32 of an inch as noted above by reference to FIG. 2. The target area of the substrate thus overshoots the print position by almost a full 1/32 of an inch, which is acceptable for many applications. This positioning error may be reduced by using an encoder with a higher resolution, for example, an encoder that generates a signal for every 1/64 of an inch movement of the substrate.

A second example is based on the same assumptions as the first example except that the substrate moves at a speed of 925 inches per minute. By reference to FIG. 2, the substrate S moves somewhat less than 15/32 of an inch in 30 milliseconds, which is the period of the timer 160. Thus only 14 signals are generated by the encoder 140 since the substrate moved a full 14/32 of an inch but not quite a full 15/32 of an inch. The speed counter thus decrements the reference count of 30 by 14 resulting in a DELAY COUNT of 16, which is stored in the delay counter 170. A trigger signal T disables the speed counter 160 and enables the delay counter 170. The encoder signals then decrement the DELAY COUNT of the enabled delay counter 170 until the delay count reaches zero at which time the print signal is generated. According to this example, when the DELAY COUNT of 16 reaches zero, the target area of the substrate S will have moved 16/30 inches, which is more than half way to the print position, before the print signal is generated. But the print head actuation delay time is 30 milliseconds, which corresponds to an additional distance that is somewhat less than 15/32 of an inch as noted above by reference to FIG. 2. The target area of the substrate thus overshoots the print position by somewhat less than 1/32 of an inch, which is acceptable for many applications. Here again the positioning error may be reduced by using an encoder with a higher resolution.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A system for printing an image onto a target area of a moving substrate with an actuatable print head having an actuation delay time, the substrate movable at a variable speed to a print position relative to the print head, the system comprising:

a trigger signal generator for generating a trigger signal when the target area of the substrate is a distance from the print position, the distance selected so that a time required to move the target area of the substrate the distance to the print position is not less than the actuation delay time of the print head;

an encoder for generating first signals based on movement of the substrate;

a first device for decrementing a reference count for every first signal generated to generate a delay count, the reference count corresponding to a number of first signals generated as the target area moves the distance to the print position;

a second device for decrementing the delay count for every first signal generated upon generation of the trigger signal; and a third device for generating a print signal when the delay count is decremented to zero, wherein generation of the print signal is delayed for the delay count in response to the trigger signal, and wherein the print head is actuated in response to the print signal to print the image onto the target area of the substrate.

2. The system of claim 1, the encoder is a rotary encoder in contact with the moving substrate, the rotary encoder generating a first signal for every incremental unit of distance moved by the substrate.

3. The system of claim 1 further comprising a timer having a time period corresponding to the actuation delay time or the print head the first device is a first counter that generates the delay count during the time period of the timer, and the second device is a second counter that stores the delay count after the time period of the timer.

4. The system of claim 1 further comprising a timer memory register of a digital computing device for storing a time period corresponding to the actuation delay time of the print head, the first device is a first memory register of the digital computing device for storing the reference count, the reference count decremented for every first signal generated to generate the delay count during the time period of the timer memory register, and the second device is a second memory register of the computing device for storing the delay count, the delay count decremented for every first signal generated upon generation of the trigger signal.

5. A method for printing an image onto a target area of a moving substrate with an actuatable print head having an actuation delay time, the substrate movable at a variable speed to a print position relative to the print head, the method comprising steps of:

generating first signals based on movement of the substrate;

storing a reference count corresponding to a number of first signals generated as the target area of the substrate moves a distance to the print position;

generating a delay count by decrementing the reference count for every first signal generated;

storing the delay count;

generating a trigger signal when the target area of the substrate is the distance from the print position, the distance selected so that a time required to move the target area of the substrate the distance to the print position is not less than the actuation delay time of the print head;

decrementing the delay count for every first signal generated upon generation of the trigger signal;

generating a print signal when the delay count is decremented to zero; and actuating the print head in response to the print signal to print the image onto the target area of the substrate, wherein generation of the print signal is delayed for the delay count in response to the trigger signal.

6. The method of claim 5 further comprising steps of:

storing the reference count in a first counter;

generating the delay count by decrementing the reference count stored in the first counter for every first signal generated during a time period corresponding to the actuation delay time of the print head;

storing the delay count in a second counter;

decrementing the delay count stored in the second counter for every first signal generated upon generation of the trigger signal, the delay count decremented until the delay count is zero; and generating the print signal when the delay count stored in the second counter is decremented to zero.

7. The method of claim 6 further comprising steps of:

generating a new delay count during successive time periods corresponding to the actuation delay time of the print head;

replacing the stored delay count with the new delay count;

disabling the first counter upon generation of the trigger signal; and enabling the second counter upon generation of the trigger signal, wherein the delay count stored in the enabled second counter is decremented for every first signal generated.

8. The method of claim 6 further comprising steps of generating the first signals with an encoder for every incremental unit of distance moved by the substrate.

9. The method of claim 5 further comprising steps of:

storing the reference count in a first memory register;

generating the delay count by decrementing the reference count stored in the first memory register for every first signal generated during a time period corresponding to the actuation delay time of the print head;

storing the delay count in a second memory register;

decrementing the delay count stored in the second memory register for every first signal generated upon generation of the trigger signal, the delay count decremented until the delay count is zero; and generating the print signal when the delay count stored in the second counter is decremented to zero.

* * * * *